US011452651B2

(12) United States Patent
Lorentzen et al.

(10) Patent No.: US 11,452,651 B2
(45) Date of Patent: Sep. 27, 2022

(54) PRESSURIZATION OF A SUPPORT STRUCTURE FOR HANDLING OF A PERSON

(71) Applicant: TIDEWAVE R&D AS, Stavanger (NO)

(72) Inventors: Bjørn Sebastian Lorentzen, Stavanger (NO); Andreas Smith, Sandnes (NO)

(73) Assignee: TIDEWAVE R&D AS, Stavanger (NO)

( * ) Notice: Subject to any disclaimer, the term of this patent is extended or adjusted under 35 U.S.C. 154(b) by 299 days.

(21) Appl. No.: 16/768,587

(22) PCT Filed: Dec. 14, 2018

(86) PCT No.: PCT/EP2018/084913
§ 371 (c)(1),
(2) Date: May 29, 2020

(87) PCT Pub. No.: WO2019/115752
PCT Pub. Date: Jun. 20, 2019

(65) Prior Publication Data

US 2021/0169722 A1 Jun. 10, 2021

(30) Foreign Application Priority Data

Dec. 14, 2017 (SE) ..... 1751553-7

(51) Int. Cl.
*A61G 7/00* (2006.01)
*A61G 7/057* (2006.01)

(52) U.S. Cl.
CPC ..... *A61G 7/05776* (2013.01); *A61G 7/001* (2013.01); *A61G 2203/10* (2013.01); *A61G 2203/34* (2013.01)

(58) Field of Classification Search
CPC ..... A61G 7/00; A61G 7/001; A61G 7/008; A61G 7/05776; A61G 2203/10; A61G 2203/34
See application file for complete search history.

(56) References Cited

U.S. PATENT DOCUMENTS 4,934,002 A * 6/1990 Watanabe ..... A61G 7/008 5/607
6,073,290 A 6/2000 Miller, Sr.
(Continued)

FOREIGN PATENT DOCUMENTS

CA 2095736 4/1997
CH 577312 A5 7/1976
(Continued)

*Primary Examiner* — Fredrick C Conley
(74) *Attorney, Agent, or Firm* — James S. Keddie; Bozicevic, Field & Francis LLP

(57) ABSTRACT

The present disclosure relates to a system and method for controlling the pressurization of a support structure for handling of a person, the support structure comprising: a body comprising a row of at least two elongated sections adapted to be pressurized; a carrier plate, wherein, in a pressurized loaded condition of one or more of the elongated sections, the carrier plate is adapted to form an at least partially concavely curved front surface; a power unit adapted to pressurize one or more parts of the support structure individually via a respective valve; one or more sensors adapted to measure movements of the person and/or variations or deviations in pressurized parts of the support structure; and a controller configured to control the power unit to pressurize each part of the support structure that is adapted to be pressurized individually, based at least on sensor measurement data from the one or more sensors.

16 Claims, 12 Drawing Sheets

(56) References Cited

U.S. PATENT DOCUMENTS

| | | | | |
|---|---|---|---|---|
| 6,230,342 | B1 * | 5/2001 | Haugs | A61G 7/05776 5/607 |
| 11,116,679 | B2 * | 9/2021 | Carter | A61G 7/05 |
| 2004/0064896 | A1 | 4/2004 | Partian | |
| 2006/0085919 | A1 | 4/2006 | Kramer et al. | |
| 2006/0236464 | A1 | 10/2006 | Beck et al. | |
| 2008/0034501 | A1 | 2/2008 | Hyde et al. | |
| 2011/0190674 | A1 | 8/2011 | Dahl et al. | |
| 2014/0007353 | A1 | 1/2014 | Stryker et al. | |
| 2014/0304918 | A1 | 10/2014 | Steffens et al. | |
| 2017/0056264 | A1 | 3/2017 | Chapin | |

FOREIGN PATENT DOCUMENTS

| | | | |
|---|---|---|---|
| CN | 102652701 | A | 9/2012 |
| CN | 104146842 | A | 11/2014 |
| EP | 0724422 | B1 | 8/1997 |
| EP | 2532281 | A1 | 12/2012 |
| EP | 2774591 | A2 | 9/2014 |
| JP | H09224982 | A | 9/1997 |
| KR | 20130051337 | A | 5/2013 |
| WO | WO 97/30674 | A1 | 8/1997 |

* cited by examiner

PRESSURIZATION OF A SUPPORT STRUCTURE FOR HANDLING OF A PERSON

CROSS-REFERENCE TO RELATED APPLICATIONS

This application is a § 371 national phase of International Application No. PCT/EP2018/084913, filed on Dec. 14, 2018, which claims the benefit of Swedish Patent Application No. 1751553-7, filed on Dec. 14, 2017, which applications are incorporated by reference herein.

TECHNICAL FIELD

The present disclosure relates to a support structure, and to a system and method for controlling the pressurization of the support structure. According to embodiments presented herein, the support structure is adapted to receive a person, and the system is adapted to control the pressurization of the support structure such that motion is imparted on the person, in relation to a base.

BACKGROUND

A total of one in five patients at European health institutions suffer from pressure sores. The main reason is absence of regular movement. Today's solution is manual turning of patients done by health personnel, resulting in serious skin and muscle pain. For health personnel this means continuous heavy lifting of patients which results in back pain and exhaustion. For the health institutions this is expensive in terms of workload, sick leaves and patient treatment. In a broader problem view, the global aging population increases the need for automatic solutions in the health sector, as there will not be enough health professionals to assist the increasing number of elderly people.

SUMMARY

Embodiments presented herein advantageously reduce the risk of bed sores of the person, improve mobility and thereby the independency and quality of life of the person, as well as reduce the risk of work related injuries on possible health care providers assisting the person, among other things.

According to a first aspect, there is provided a system for controlling the pressurization of a support structure for handling of a person, the system comprising: a support structure adapted to be placed on a base surface, the support structure comprising: i) a body, having a front surface adapted to receive the person, and a back surface, the body comprising a row of at least two elongated sections made substantially of a first, flexible, material, wherein each elongated section is attached to its neighboring elongated section, or sections, along its longitudinal side, or sides, wherein the elongated sections are adapted to be pressurized; ii) a carrier plate having a front surface and a back surface, wherein the carrier plate is made of a second material that is less flexible than the first material, wherein the back surface of each elongated section is attached to the front surface of the carrier plate in at least one point, wherein, in a pressurized loaded condition of one or more of the elongated sections, the carrier plate is adapted to form an at least partially concavely curved front surface; and a power unit adapted to pressurize one or more parts of the support structure that is adapted to be pressurized, wherein each of said one or more parts of the support structure that is adapted to be pressurized comprises at least one of the elongated sections of the support structure, wherein the one or more parts of the support structure that is adapted to be pressurized are configured to be individually pressurized via a respective valve; The system further comprises one or more sensors adapted to measure movements of the person and/or variations or deviations in pressurized parts of the support structure in the system; and a controller comprising a data processor, the data processor being configured to generate a control signal indicative of individual pressurization of each part of the support structure that is adapted to be pressurized via a respective valve based at least on sensor measurement data from the one or more sensors, wherein the controller is configured to control the power unit to pressurize each part of the support structure that is adapted to be pressurized via the respective valve individually in response to the control signal.

According to another aspect, there is provided a method for controlling the pressurization of a support structure for handling of a person located on the support structure, the method comprising: receiving, in a controller connected to the support structure, sensor measurement data indicating movement of the person located on the support structure, and/or pressure changes or other variations or deviations in pressurized parts of the support structure, from one or more sensors; generating, by a data processor comprised in the controller, a control signal indicative of individual pressurization of each of the parts of the support structure is are adapted to be pressurized, based at least on the received sensor measurement data; and controlling, by the controller, a power unit connected to the support structure to individually pressurize each part of the support structure that is adapted to be pressurized via a respective valve, based on the control signal.

According to a further aspect there is provided a computer program loadable into a memory communicatively connected or coupled to at least one data processor, comprising software for executing the method according to any of the embodiments presented herein when the program is run on the at least one data processor.

According to yet another aspect there is provided processor-readable medium, having a program recorded thereon, where the program is to make at least one data processor execute the method according to of any of the embodiments presented herein when the program is loaded into the at least one data processor.

BRIEF DESCRIPTION OF THE DRAWINGS

The invention is now to be explained more closely by means of preferred embodiments, which are disclosed as examples, and with reference to the attached drawings.

DETAILED DESCRIPTION

Introduction

The present disclosure describes a system for controlling the pressurization of a support structure for handling of a person, especially a person lying down, to reduce the risk of bed sores of the person, improve mobility and thereby the independency and quality of life of the person, and/or reducing the risk of work related injuries on possible health care providers assisting the person. The handling of the person is in the context of the present disclosure achieved by adaptively and dynamically pressurizing a selection of the parts of the support structure that are adapted to be pressurized, for example a selection of elongated sections, or groups of elongated sections, that form the body of the support structure, thereby obtaining a curvature around the person for example lying on or leaning against the support structure. The curvature is adapted and personalized to the anatomy of the person and/or the medical or reduced mobility induced needs of the person. This is achieved by the individual pressurization of each of the elongated sections, or groups of elongated sections, that form the body of the support structure, and possibly also a selection of tilt cells, or groups of tilt cells, attached to the back surface of the support structure (the back surface of the carrier plate), as further described in connection with the figures. The pressurization/depressurization, or inflation/deflation, of the elongated sections and tilt cells of the support structure is controlled by a controller, based on sensor feedback and optionally also input provided by a user of the system, e.g. an operator.

An example of a problem that can be mitigated using the inventive support structure is physical immobility in a person, which leads to low blood flow and constant pressure on body parts that after just hours will start developing into pressure ulcers. By keeping constant movement, controlled according to embodiments presented herein, the inventors have found that pressure is relieved in a way that reduces and heals pressure ulcers.

Another concrete example where the support structure according to embodiments herein has been shown to provide a beneficial effect is for persons with multiple sclerosis. Typically, such persons regularly need to receive physiotherapy where their muscles are massaged/stretched/moved in order to reduce stiffness etc. Embodiments of the present disclosure provide individualized movement assistance during sleep or rest, and thereby reduce the need for this therapy during the active hours of the persons.

System Architecture

Below, embodiments of the inventive system are described in more detail, with reference to FIGS. 1-6.

Figure 1:
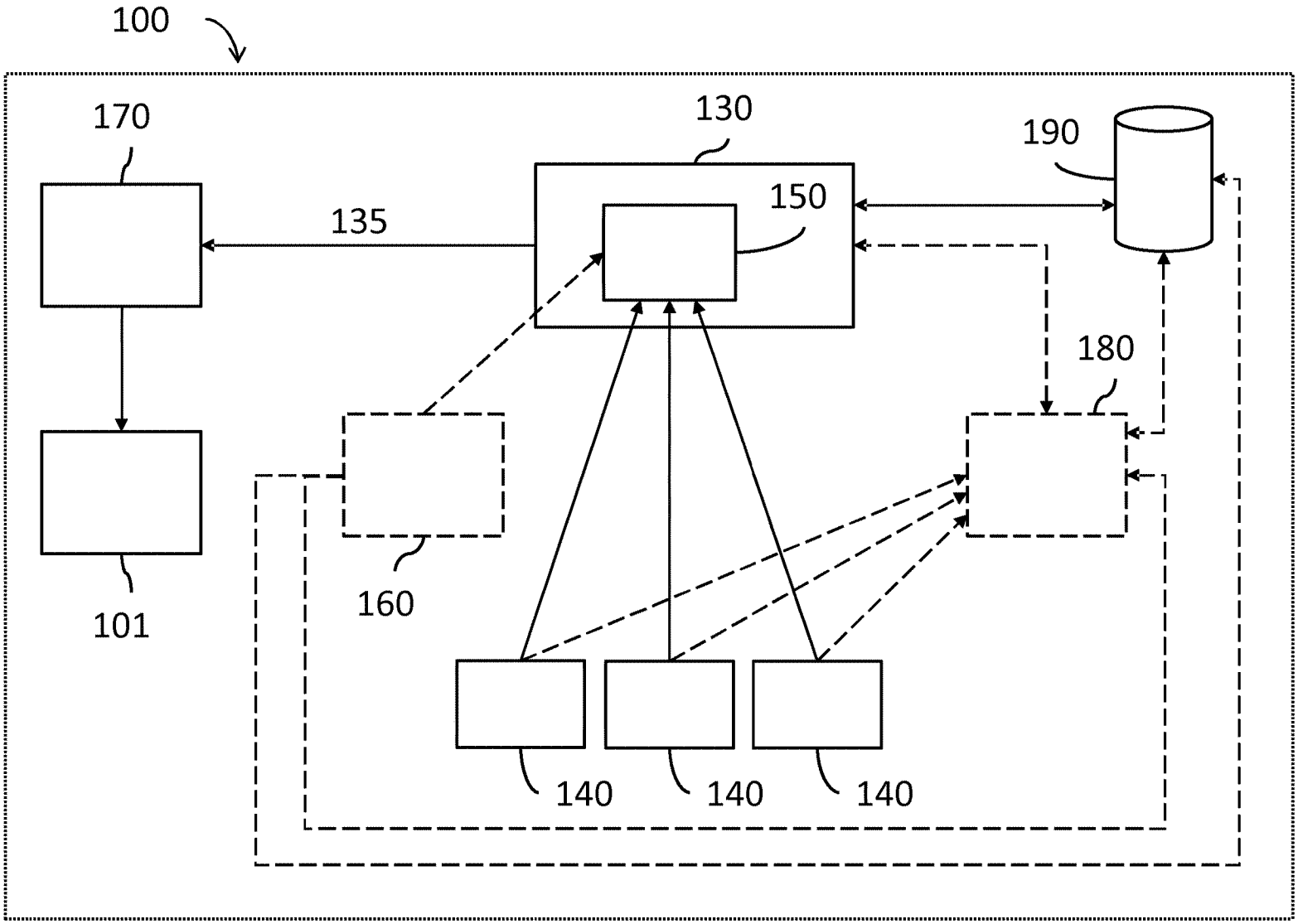
FIG. 1 shows an overview of a system according to one or more embodiments.

FIG. 1 shows a system 100, according to embodiments of the invention, for controlling the pressurization of a support structure for handling of a person. The system 100 comprises a support structure 101, a power unit 170, one or more sensors 140 and a controller 130.

Figure 2:
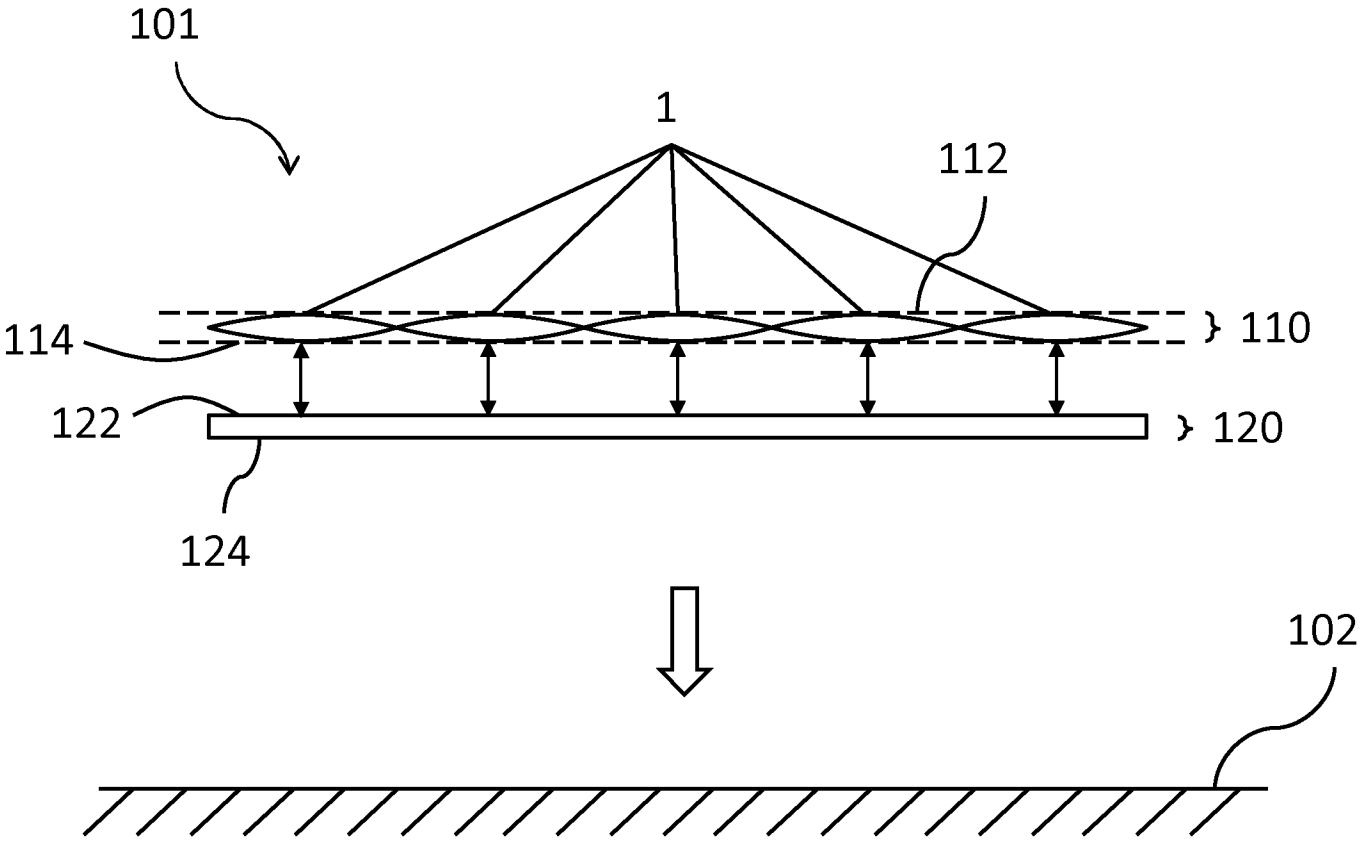
FIG. 2 shows an overview of a support structure according to one or more embodiments.
Figure 3A:
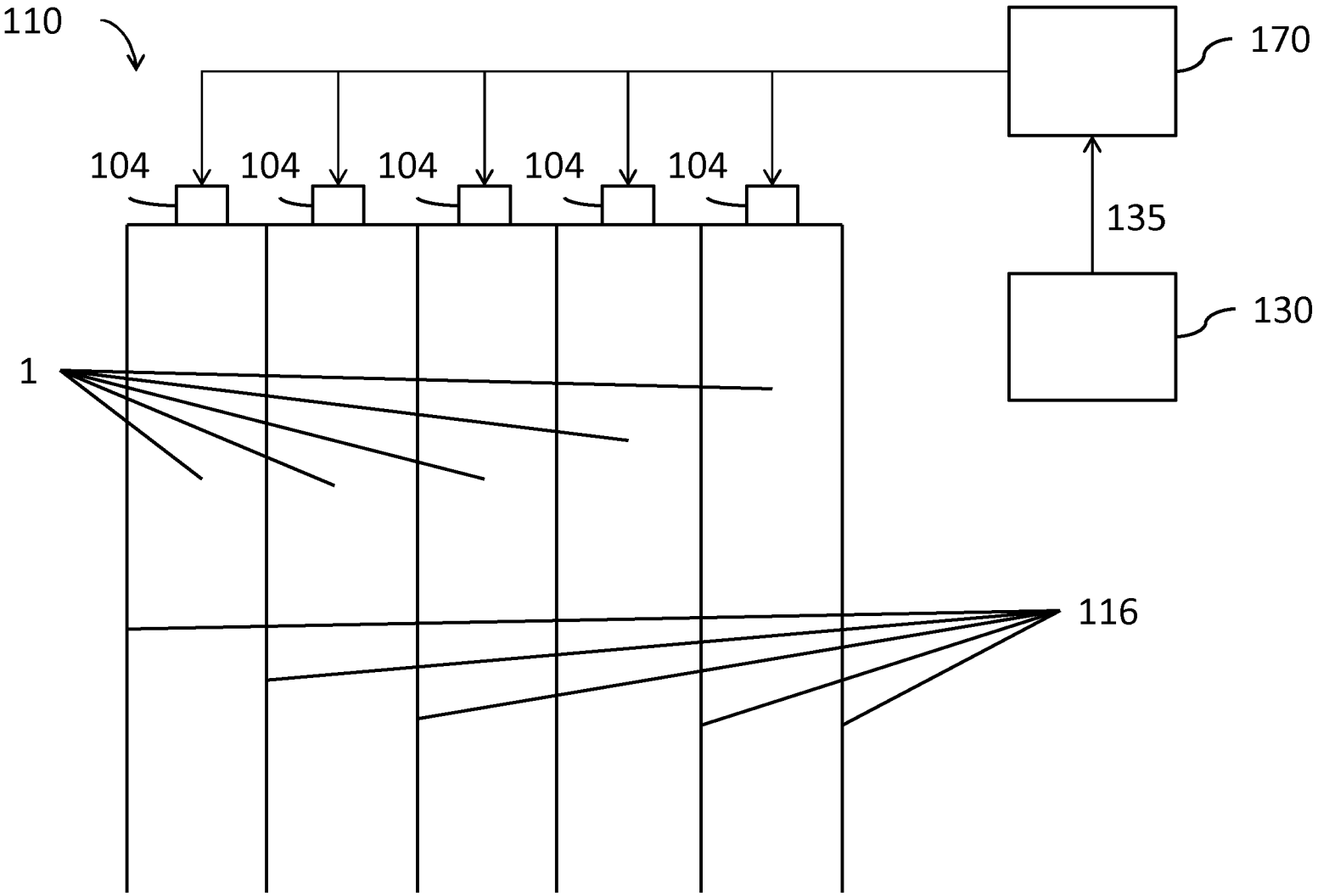
FIG. 3*a* shows a top view of a support structure according to one or more embodiments, and a schematic view of a part of a system according to one or more embodiments.
Figure 3B:
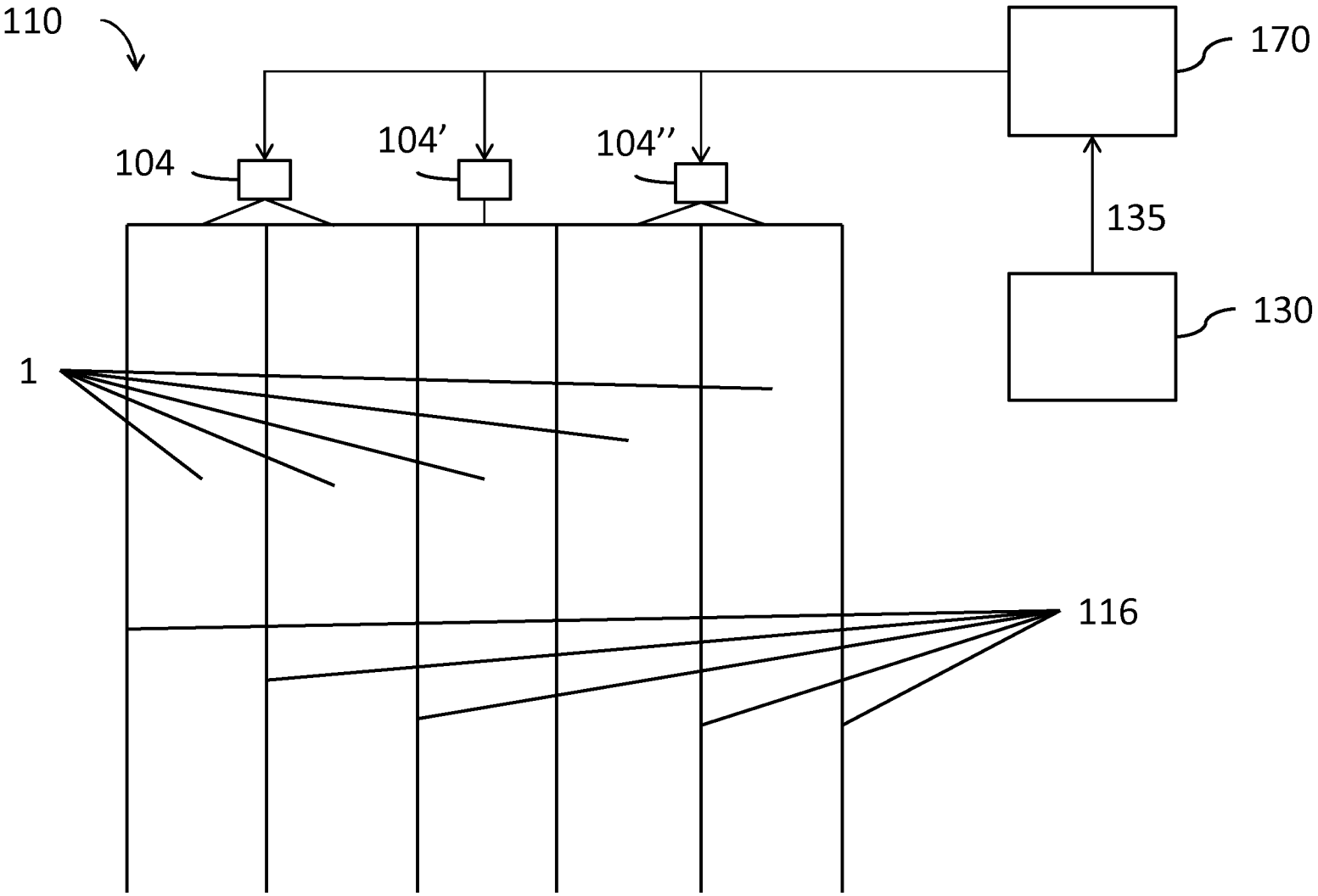
FIG. 3*b* shows a top view of a support structure according to one or more embodiments, and a schematic view of a part of a system according to one or more embodiments.

The support structure is adapted to be placed on a base surface 102, and comprises a body 110 having a front surface 112 adapted to receive the person, and a back surface 114. An overview of the parts of the support structure is shown in FIGS. 2, 3*a* and 3*b*. FIG. 2 shows the body 110 and the carrier plate 120 in a cross-sectional as seen along the direction of the longitudinal extension of the support structure 101 (corresponding to the direction of the longitudinal axis A of FIG. 5, or an axis parallel to axis A). FIGS. 3*a* and 3*b* show a top view of the support structure 101, as seen when looking onto the front surface 112 of the body 110, and a schematic view of a part of the system 100 according to embodiments presented herein.

Figure 5:
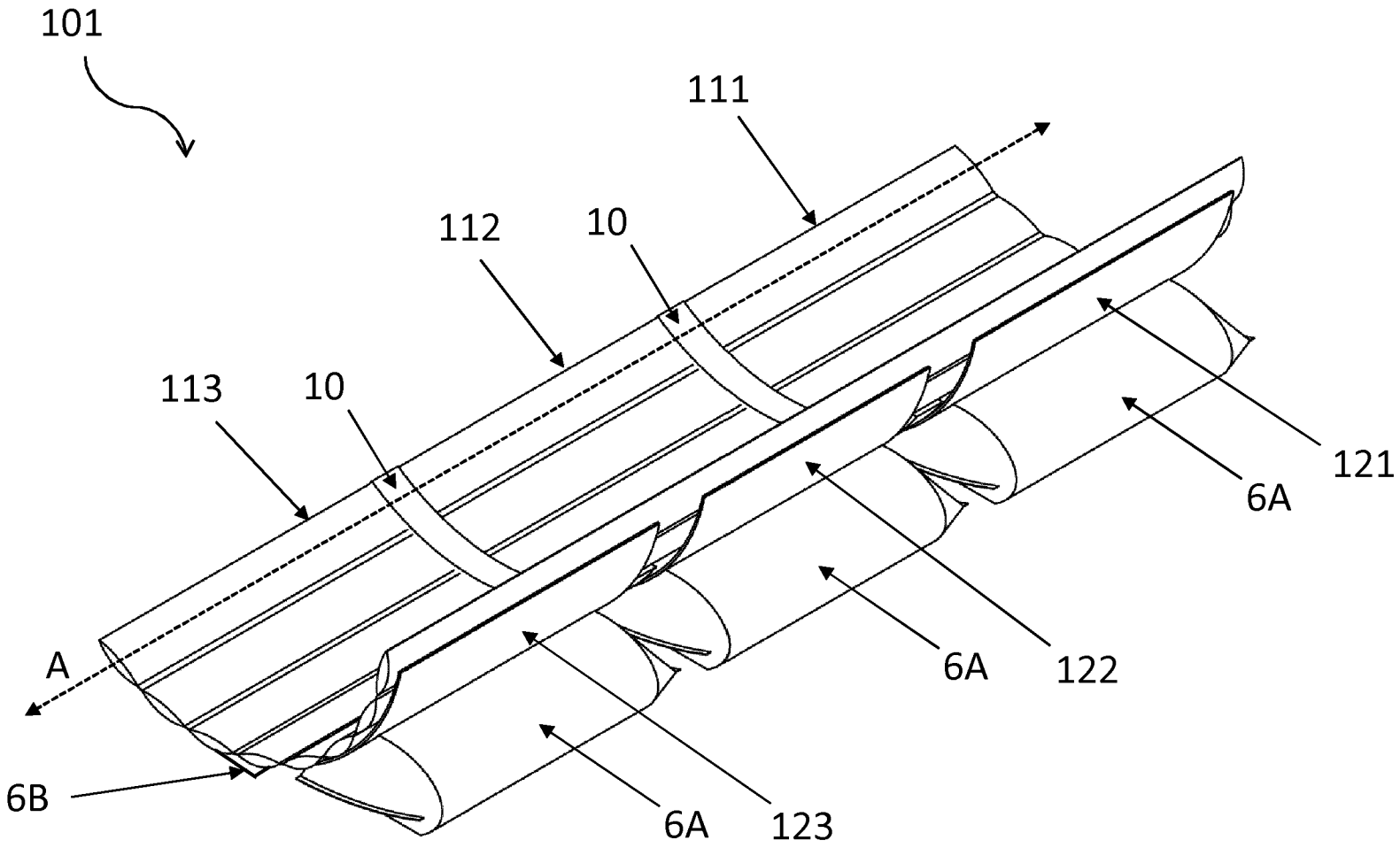
FIG. 5 shows an overview of a support structure according to one or more embodiments.

The body 110 comprises a row of at least two elongated sections 1 made substantially of a first, flexible, material. Each elongated section 1 is attached to its neighboring elongated section, or sections, 1, along its longitudinal side, or sides, 116. In different exemplary embodiments, each elongated section 1 may be attached to its neighboring section or sections 1 by welding, gluing, sowing or other suitable attachment methods. The elongated sections are tiltably or rotatably attached to each other. In other words, for each elongated section 1 there is, as illustrated in FIG. 5, defined an axis A extending in the direction of the extension of the elongated section 1, whereby the elongated sections are attached in a manner allowing a rotation angle between the elongated section 1 and its neighboring elongated section or sections 1 to be altered by rotation around the axis A, or an axis parallel to the axis A. This enables the body 110 to curve in different manners according to the individual pressurization according to embodiments presented herein.

The elongated sections 1 are adapted to be pressurized and/or depressurized, e.g. pneumatically or hydraulically inflated and/or deflated. Hereinafter, in the context of this application, the term pressurize may be used in the meaning of either increasing pressure, decreasing pressure, inflate or deflate. The flexible first material allows the elongated sections 1 to change their shape and/or volume when they are pressurized. According to one or more advantageous embodiments, the elongated sections 1 are configured to be individually pressurized. According to other advantageous embodiments, two or more groups of elongated sections 1 are configured to be individually pressurized. In different embodiments described herein, either a single elongated section 1, or a group comprising two or more elongated sections 1, may be referred to as a part of the support structure 101 that is adapted to be pressurized.

The first material may for example be a polymer or other canvas, a nylon based material, or another material with suitable properties, including flexibility. The power unit 170 is adapted to pressurize one or more parts of the support structure that are adapted to be pressurized, for example one or more elongated sections 1 and/or one or more tilt cell of the support structure 101. According to embodiments, the system 100 comprises, for each part of the support structure 101 that is adapted to be pressurized, such as the elongated sections 1 and tilt cells, or groups of elongated sections 1 and/or tilt cells, (described below), a respective valve 104.

Hereinafter, a part of the support structure 101 that is adapted to be pressurized may for ease of reading be referred to as a part of the support structure 101.

A part of the support structure 101 that is adapted to be pressurized may comprise a single elongated section or tilt cell connected to a valve 104. This is illustrated for the elongated sections 1 in FIG. 3*a*. Alternatively, a part of the support structure 101 that is adapted to be pressurized may comprise a group of elongated sections 1 and/or tilt cells connected to a valve 104. This is illustrated by the non-limiting example configuration shown in FIG. 3*b*, wherein the valve 104 is connected to a part of the support structure 101 comprising two elongated sections 1, the valve 104' is connected to a part of the support structure 101 comprising a single elongated section 1, and the valve 104" is connected to a part of the support structure 101 comprising two elongated sections 1, but many other options for grouping elongated sections 1 and/or tilt cells 6A, 6B, 14 are of course feasible.

In some embodiments, the support structure 101 comprises a selection of at least two of the following:

- one or more parts that consist of a single elongated section 1 connected to a respective valve 104;
- one or more parts that consist of a single tilt cell connected to a respective valve 104; and
- one or more parts that comprise of a group of elongated sections 1 and/or tilt cells, each group being connected to a respective valve 104.

In one or more embodiments, each part of the support structure 101 that is adapted to be pressurized is configured to be individually pressurized via a respective valve 104. In embodiments wherein a part of the support structure 101 that is adapted to be pressurized is a single elongated section 1 or tilt cell, the elongated sections 1 and tilt cells are configured to be individually pressurized via a respective valve 104, as schematically illustrated in FIG. 3*a*. In embodiments wherein a part of the support structure 101 that is adapted to be pressurized is a group of elongated sections 1 and/or tilt cells, the groups are configured to be individually pressurized via a respective valve 104, as schematically illustrated in FIG. 3*b*.

The data processor 150 is configured to generate a control signal 135 indicative of individual pressurization of each part of the support structure 101 that is adapted to be pressurized via a respective valve 104, based at least on sensor measurement data from the one or more sensors 140; and the controller 130 is configured to control the power unit 170 to pressurize each part of the support structure 101 that is adapted to be pressurized via a respective valve 104 individually in response to the control signal 135. Controlling the power unit 170 to pressurize/regulate the pressure in each part of the support structure 101 that is adapted to be pressurized via a respective valve 104 individually, the data processor may be configured to obtain sensor measurement data from the pressure sensors 140 and data from the database 190, compare the sensor measurement data to the data obtained from the database 190, and generate a control signal indicative of starting/stopping the power unit 170 and/or open and/or close a selection of the valves 104.

The power unit 170 may for example be an air pump, a compressor or any other suitable power unit configured to perform hydraulic or pneumatic pressurization. The power unit 170 may in some embodiments be controlled by the controller 130 using for example pulse width modulation or other frequency controlling methods.

Figure 4:
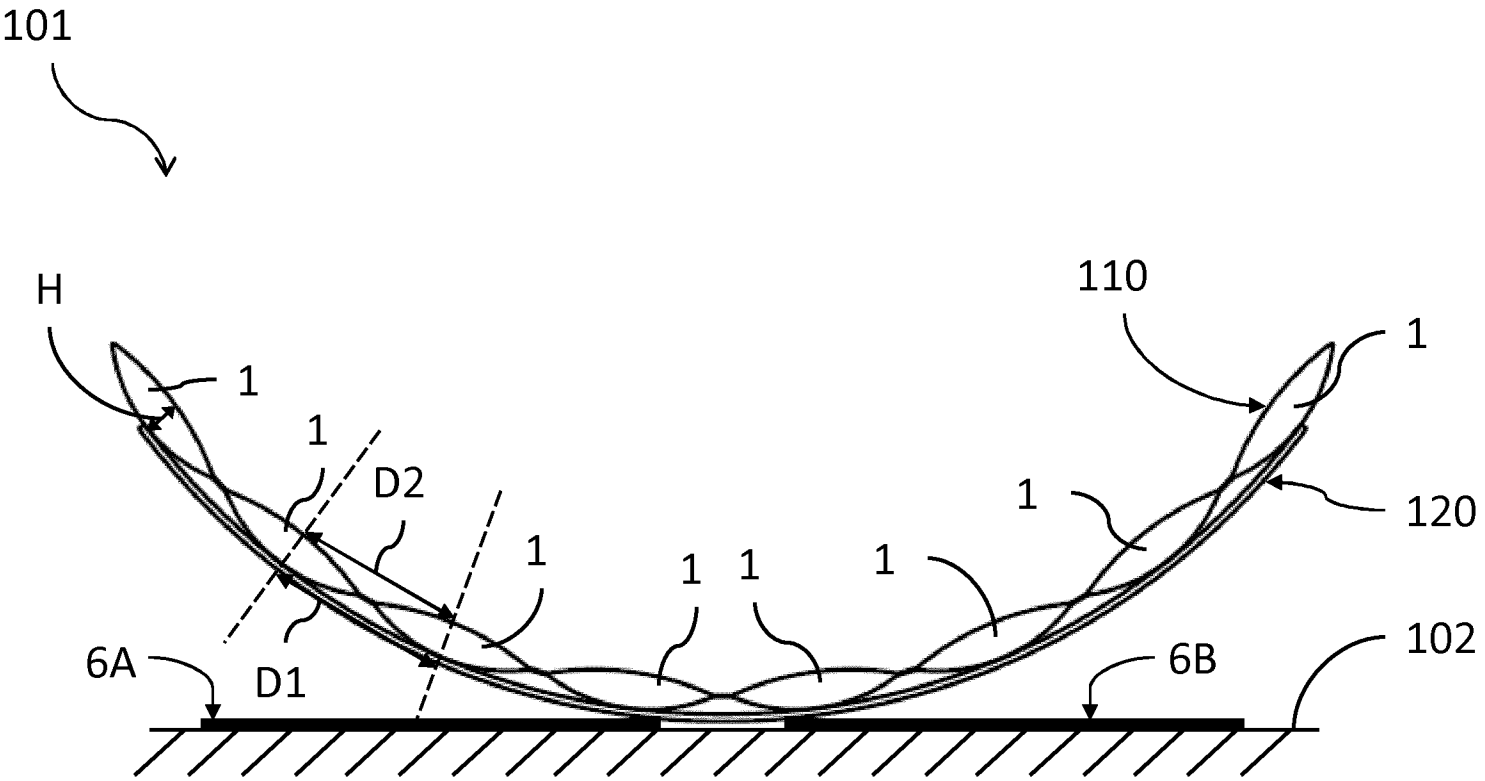
FIG. 4 shows an overview of a support structure according to one or more embodiments.

The carrier plate 120 has a front surface 122 and a back surface 124. The carrier plate 120 is made of a second material that is flexible, but less flexible than the first material. In other words, the second material is stiffer than the first material. As illustrated by the double arrows in FIG. 4, the back surface 114 of each elongated section 1 is attached to the front surface 122 of the carrier plate 120 in at least one point 4. Thereby, in a pressurized loaded/at least partly inflated condition of one or more of the parts adapted to be pressurized that comprise at least one elongated section 1, the carrier plate 120 is adapted to form an at least partially concavely curved front surface 122, as shown in FIG. 4. In the figures, the curvature of the support structure 101 is shown as being symmetric. However, as explained herein, all parts adapted to be pressurized that comprise at least one elongated section 1 are configured to be individually pressurized. Thereby, the curvature of the support structure 101 may be asymmetric, with the only condition that the carrier plate 120 is adapted to form an at least partially concavely curved front surface 122, because all the elongated sections 1 are located on the front side of the carrier plate 120. In FIG. 4, this is further illustrated by the distances D1 and D2, wherein D1 represents the distance from the latitudinal center of a first elongated section 1 to the latitudinal center of its neighboring elongated section 1 as seen from the back surface 114 of the body 110, and wherein D2 represents the distance from the latitudinal center of the first elongated section 1 to the latitudinal center of the neighboring elongated section 1 as seen from the front surface 112 of the body 110. When none of the parts adapted to be pressurized (elongated sections 1, groups of elongated sections 1, and/or tilt cells 6*a*, 6*b*, 14) are pressurized, D1 and D2 are equal, or very close to equal. However, when one or more of the parts adapted to be pressurized that comprise at least one elongated section 1 are in a pressurized loaded/at least partly inflated condition, the distance D2 will be reduced, whereby the distance D1 becomes bigger than the distance D2 for all pairs of neighboring elongated sections 1 wherein at least one of the elongated sections 1 in the pair is in a pressurized loaded/at least partly inflated condition. In other words, the carrier plate 120 obtains an at least partially concavely curved front surface 122.

As the second material is stiffer than the first material, the curvation of the carrier plate provides support for and helps retain the shape obtained by pressurizing the at least one elongated section 1 when a person is lying, or sitting, on the support structure 101.

Figure 10:
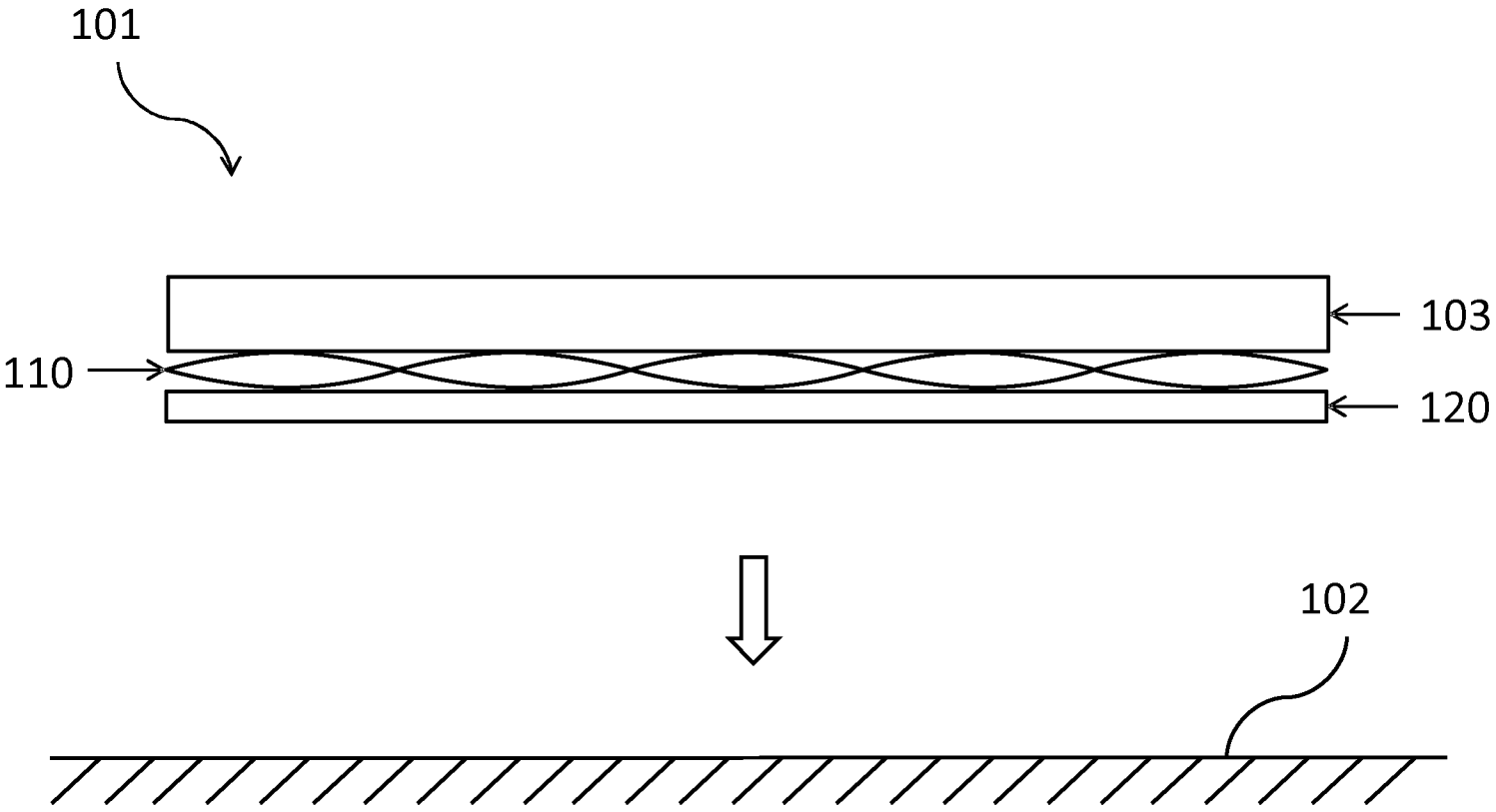
FIG. 10 shows an overview of a support structure in combination with a mattress or bed rest, according to one or more embodiments.
Figure 11:
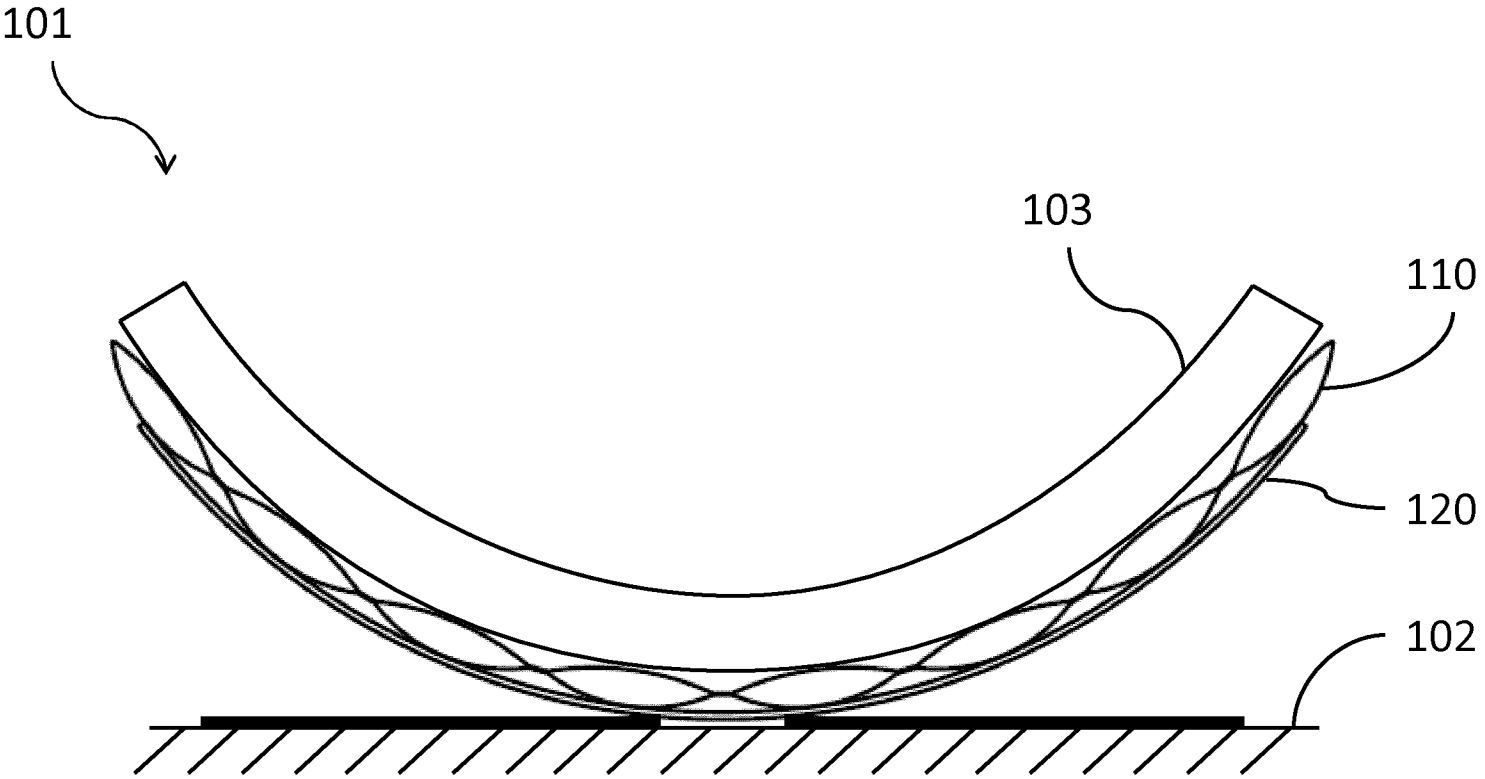
FIG. 11 shows an overview of a support structure in combination with a mattress or bed rest, according to one or more embodiments.

In some embodiments, like the ones illustrated in FIGS. 10 and 11, the system 100 may comprise an integrated mattress or bed rest 103, or be intended for use with a separate mattress or bed rest 103. In other words, a mattress or bed rest 103 may be an integrated part of the support structure 101, or a separate part that the support structure 101 is adapted to receive on its top surface, wherein the support structure 101 is further configured to receive a person on top of the mattress or bed rest 103. In some embodiments, the support structure 101 of the system 100 may be placed under a mattress or bed rest 103 and used in a bed for example in a home environment or at a health care or elderly care facility. In the context of this disclosure, when it is stated that something is received or located on, or a person is lying or sitting on, the support structure 101, this also includes the case where there is a mattress, bed rest and the like placed between the support structure 101 and the object or person.

Referring again to FIG. 1, the one or more sensors 140 comprised in the system 100 are adapted to measure parameters such as for example the internal pressure of a respective part of the support structure 101, wherein the one or more sensors 140 comprise one or more pressure sensor, or acceleration of a respective part of the support structure 101, wherein the one or more sensors 140 comprise one or more accelerometer configured to measures rotation (X, Y and Z coordinate) of the elongated section or tilt cell in which it is comprised. The controller 130 is communicatively connected to a data processor 150. The data processor 150 may be comprised/integrated in the controller 130 (as in the example shown in the figure), or be a unit separate from the controller 130.

The data processor 150 is configured to receive sensor data indicative of the measured parameters from at least one of the one or more sensors 140, and to generate a control signal 135 indicative of individual pressurization objectives for each of the elongated sections 1, or other parts of the support structure 101, based at least on the sensor data received from the at least one of the one or more sensors 140. In one or more embodiments, the data processor 150 may be configured to process the received sensor data, for example by determining, based on pressure data and/or acceleration data measured by the one or more sensors, information regarding movements of the person and/or relative movement of parts of the support structure 101, for example tilting of one or more elongated section and/or tilt cell. According to such embodiments, the data processor 150 may generate a control signal 135 indicative of individual pressurization objectives for each of the elongated sections 1, or other parts of the support structure 101, based at least on the processed sensor data, for example information regarding movements of the person and/or relative movement of parts of the support structure 101. The sensors 140 may be configured to measure, and possibly also send, data either continuously or discretely at predetermined time intervals, such that real time or close to real time measurement data, and consequently real time or close to real time adaptive pressure controlling, is enabled.

Since pressurization of one or more elongated section 1 and/or tilt cell causes rotation of the support structure 101, rotation caused by the person moving, tilt cells being pressurized etc. is directly detectable by the data processor 150, in real time or close to real time, which enables the real time, or close to real time, controlling of the power unit 170 by the controller 130 in response to the detected rotation. The same is of course true for other types of inline sensors used, such as for example the pressure sensors described herein. Thereby, the movement patterns of the support structure can be controlled and the given individual pressurization objectives can be updated in real time to optimize the result. Pressure changes and/or rotation of one or more elongated section and/or tilt cell may be caused by for example temperature buildup in the environment, the temperature of the person on the support structure 101, hence adjusting or introducing new or old air/liquid in the system, and/or deviations caused by such as potential leakage, blockage and other negative causes, etc. In some embodiments, information about the progress of the pressurization and/or information on how well the system is performing (good, bad neutral for example) is fed back to the database 190. This information can be used by the system 100 to learn and improve its functionality, for example via logic comprised in a machine learning module 180. Once enough data has been stored in the database 190, then the system 100 will become more or less autonomous. In one or more embodiments presented herein, the control data, such as the control signal 135, provided by the system 100 may always be overridden by a human user providing input via a user interface 160, as presented herein.

In a non-limiting use case example, a respective given tilt value to be reached by one or more parts of the support structure 101 may be set in the system 100. In this example, the support structure 101 may be halfway from its original position to the given tilt value(s) and the data processor 150 is aware of this from the sensor data, continuously or discretely sent to and received by the data processor 130 from the one or more sensors 140. From the received sensor data, the data processor may be configured to determine for example the tilt angle, compared to a defined starting value, of a part of the support structure 101 associated with a specific accelerometer or other sensor adapted to measure a tilt angle. Also, by measuring the internal pressure via one or more pressure sensor associated with one or more parts of the support structure 101, the data processor 150 can determine whether the person is moving, e.g. by analyzing changes in pressure in one or more parts of the support structure 101 between two measurements, a change compared to a given starting value, or continuous change over time. For example, the analysis may show that the pressure in a part located at one side of the support structure increases while the pressure in a part at an opposing side of the support structure decreases, the data processes may interpret this as the person moving on the support structure 101, i.e. the center of gravity of the person is moving from one side of the support structure 101 to the other. Based on this information, the data processor 150 may be configured to generate a control signal 135 indicative of individual pressurization objectives for each of the parts of the support structure 101 that are adapted to be pressurized. In a non-limiting embodiment, this may mean that the data processor 150 generates a control signal 135 indicative of individual pressurization objectives for each of the elongated sections 1, for use by the controller 130. In another non-limiting embodiment, this may mean that the data processor 150 generates a control signal 135 indicative of individual pressurization objectives for each of two or more groups of elongated sections 1, for use by the controller 130. The power unit 170 is adapted to pressurize one or more of the parts of the support structure 101 that are adapted to be pressurized, for example each of the elongated sections 1, each of the tilt cells, or each of the groups of elongated sections 1 and/or tilt cells, and the controller 130 is configured to control the power unit 170 to pressurize the parts of the support structure 101 that are adapted to be pressurized individually in response to the control signal 135, i.e. according to the individual pressurization objectives indicated in/defined by the control signal 135.

In some embodiments, the sensors 140 may be inline sensors located within each of the elongated sections 1 and/or tilt cells described herein, thereby enabling continuous measurement of the pressure and/or other parameters of pressurized parts of the system 100 and providing feedback to the controller 130 and data processor 150 for dynamic adaptation of the pressure. This enables optimized adaptation to e.g. the anatomy, the sleep patterns and/or the movement patterns of the person on or enclosed by the support structure 101. In one or more embodiments, the inline sensors are configured to measure real time pressure values, thereby enabling the controller 130 to reinitiate any given state during operation of the system 100. Other input may also be provided to the controller 130, and taken into consideration, e.g. provided via an input device, a user interface, based on machine learning and/or a training data library, etc.

In some embodiments, the sensors 140, which provide feedback to the controller 130, comprise inline pressure sensors, which in this context is defined as sensors configured to measure an internal pressure in different parts of the system, e.g. in each of the elongated sections 1 and/or tilt cells. In difference to sensors measuring only externally induced pressure, measurement and feedback of internal pressure enables the inflated/pressurized parts of the system to completely deflate/depressurize and keep the controller informed of the exact progress of the deflation/depressurizing process. This may advantageously be used for a number of purposes, such as e.g. initiating the initial settings, or enabling better control over the pressurization of the elongated sections 1 and/or tilt cells of the support structure, by providing real time feedback to the controller 130 and enabling determination of exactly where in the pressurization process the system 100 is at any given time.

The individual pressurization objectives relate to achieving desired movement/movements to acquire certain conditions, and may according to some non-limiting examples comprise a selection of: very slowly turning a person from side to side (tilting back and forth) during the night, giving them the movement, and hence pressure reduction, better blood flow and relaxation and softening of muscles etc., without waking them up; in other ways keeping the person in constant movement, hence relieving pressure, giving better blood flow, softens the muscles etc.; providing the movement or movement scheme that an healthy/fully mobile person can do automatically, for example sitting up, getting out of bed, rolling onto the side or from the side to the back etc. Since the support structure is flexible in the longitude direction, this makes it possible to give movement stimuli even if the support structure is presently in the upright position, i.e. that the upper part 111 has been tilted in relation to the middle part 112. For any of the embodiments described herein, the system 100 may further comprise a user interface 160 configured to forward user input parameters to the data processor 150. The data processor 150 is in these embodiments configured to receive user input parameters from the user interface 160. The user input parameters are in these embodiments preferably generated in response to user commands entered via by a user interacting with one or more input devices connected to the user interface 160. The one or more input devices may comprise a keyboard and/or computer mouse or other pointing device, touchscreen or any other suitable input device. The input may be provided via a graphical user interface (GUI) presented on a display by the user interface 160.

In some embodiments, the system 100 may further comprise a database 190 configured to store information and parameters relating to individual pressurization objectives for the parts of the system 100 that can be pressurized by the pressure unit 170. The database 190 may further be configured to store such information and parameters in relation to a selection of: unique user data identifying the person to be placed on the system 100; experience based data on preferable pressure settings for each identified person; experience based data on preferable pressure settings depending decrease the risk of bedsores or the like, for obtaining good sleeping quality, for helping the person performing a movement or a series of movements, etc.

In one or more embodiments, the database 190 is updated with parameters obtained from the one or more sensors 140, manual user input via the user interface 160, information from the machine learning module 180 and/or feedback from other units of the system 100 obtained during operation.

The information received in the database 190 may comprise for example as how long the person has been in on the support structure 101 (which may in some cases correlate to how long the person has been in bed), the medical or other needs of the person, any issues occurring, etc., basically any type of information that can be measured by a sensor or input manually and that may be relevant to the controlling of the pressurization/the individual pressurization objectives. The controller 130 may further be configured to receive input parameters from the database 190, and to generate the control signal 135 based also on the input parameters received from the database 190, in combination with input parameters obtained in any of the embodiments above.

In some embodiments, the system 100 comprises a machine learning module 180, which may be configured to generate experience based data on preferable pressure settings for different persons and/or medical situations or defined aims to be achieved. In order to generate the experience based data, the machine learning module 180 may be configured to receive and process information and parameters stored in the database 190, sensor data from the one or more sensors 140, user input parameters obtained via the user interface 160 and/or data from the controller 130 indicative of individual pressurization objectives for current or previous applications. The machine learning module may further be configured to send experience based data to the controller 130, and the controller 130 may further be configured to generate an control signal 135 based on the input parameters received from the machine learning module 180, in combination with input parameters obtained in any of the embodiments above.

Figure 6:
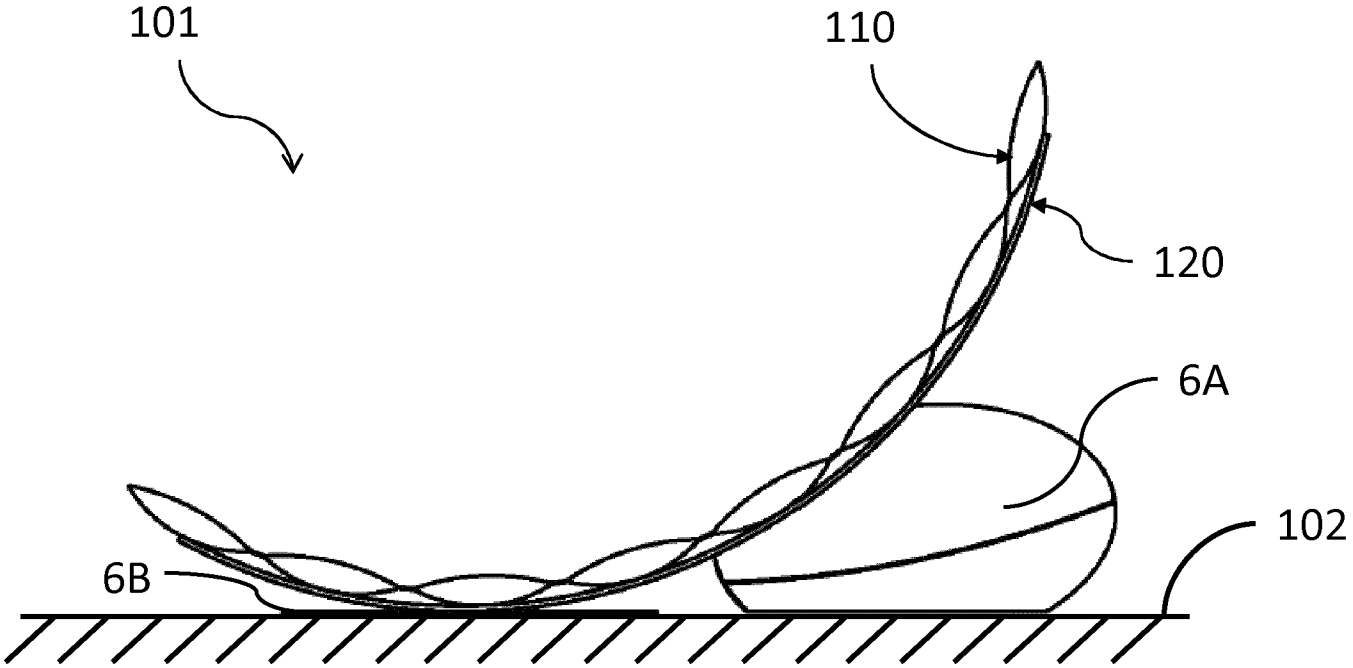
FIG. 6 shows an overview of a support structure according to one or more embodiments.

In some embodiments, illustrated in FIGS. 4 and 5, the wherein the parts of the support structure 101 that are adapted to be pressurized via a respective valve 104 further comprise, along a first longitudinal side of the support structure 101, which corresponds to along an axis parallel with an axis A of any the elongated sections land attached to the back surface 124 of the carrier plate 120, two or more inflatable lateral tilt cells 6A; and along a second longitudinal side of the support structure 101, which corresponds to along an axis parallel with an axis A of any the elongated sections 1 and attached to the back surface 124 of the carrier plate 120, two or more inflatable tilt cells 6B, wherein the two or more inflatable lateral tilt cells 6A, 6B on the respective side are adapted to, when in a pressurized loaded (at least partly inflated) condition, tilt the body 110 and the carrier plate 120 around the longitudinal axis A. The control signal 135 may further be indicative of individual pressurization objectives of the two or more inflatable tilt cells 6A, 6B of each respective side of the system 100, whereby the controller 130 may be configured to also individually control the pressurization of each of the two or more inflatable lateral tilt cells 6A, 6B of each side in response to the control signal 135. FIG. 6, illustrates such a scenario, wherein the lateral tilt cell 6A has just been pressurized (inflated) and lateral tilt cell 6B has been depressurized (deflated), thereby causing the support structure to rotate around an axis parallel to the axis A.

In a non-limiting example of using the present system 100 for relieving pressure in an immobile person or improve the sleeping quality of a person, e.g., the controller 130 may control the pressurization of the elongated sections 1 and the lateral tilt cells 6A, 6B through pneumatic or hydraulic pressure such that the body 110 of the support structure 101 slowly curves around a person lying on it to ensure good support, followed by turning/tilting up to 30 degrees from side to side during the hours of the night, by continuously pressurizing and depressurizing the lateral tilt cells 6A, 6B according to a predetermined pattern, possibly adapted over time based on continuous feedback from the sensors 140 of the system 100. The procedure is advantageously un-noticeable for the person as the movement is done slowly and gentle.

Figure 8:
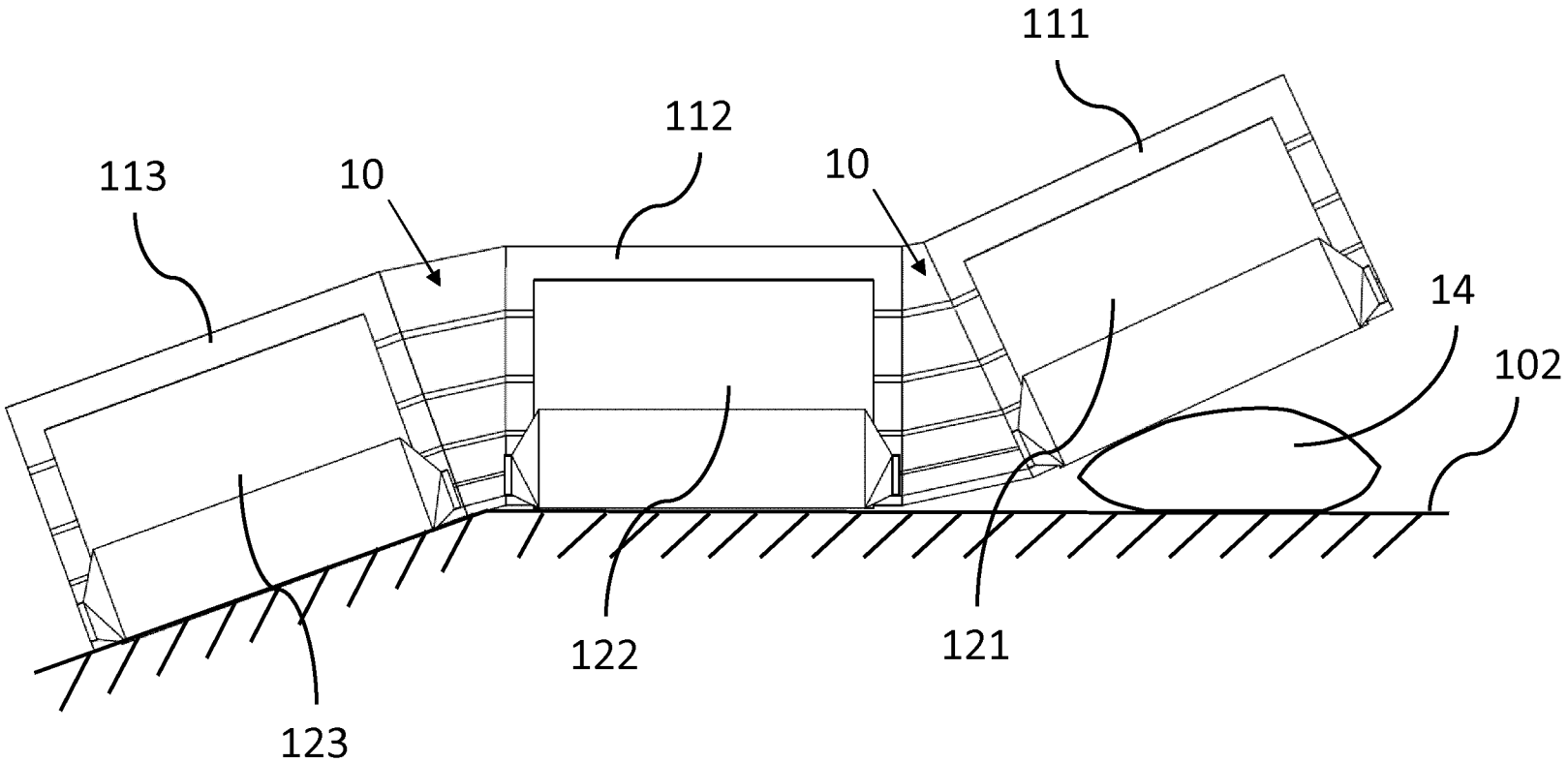
FIG. 8 shows an overview of a support structure according to one or more embodiments.
Figure 9:
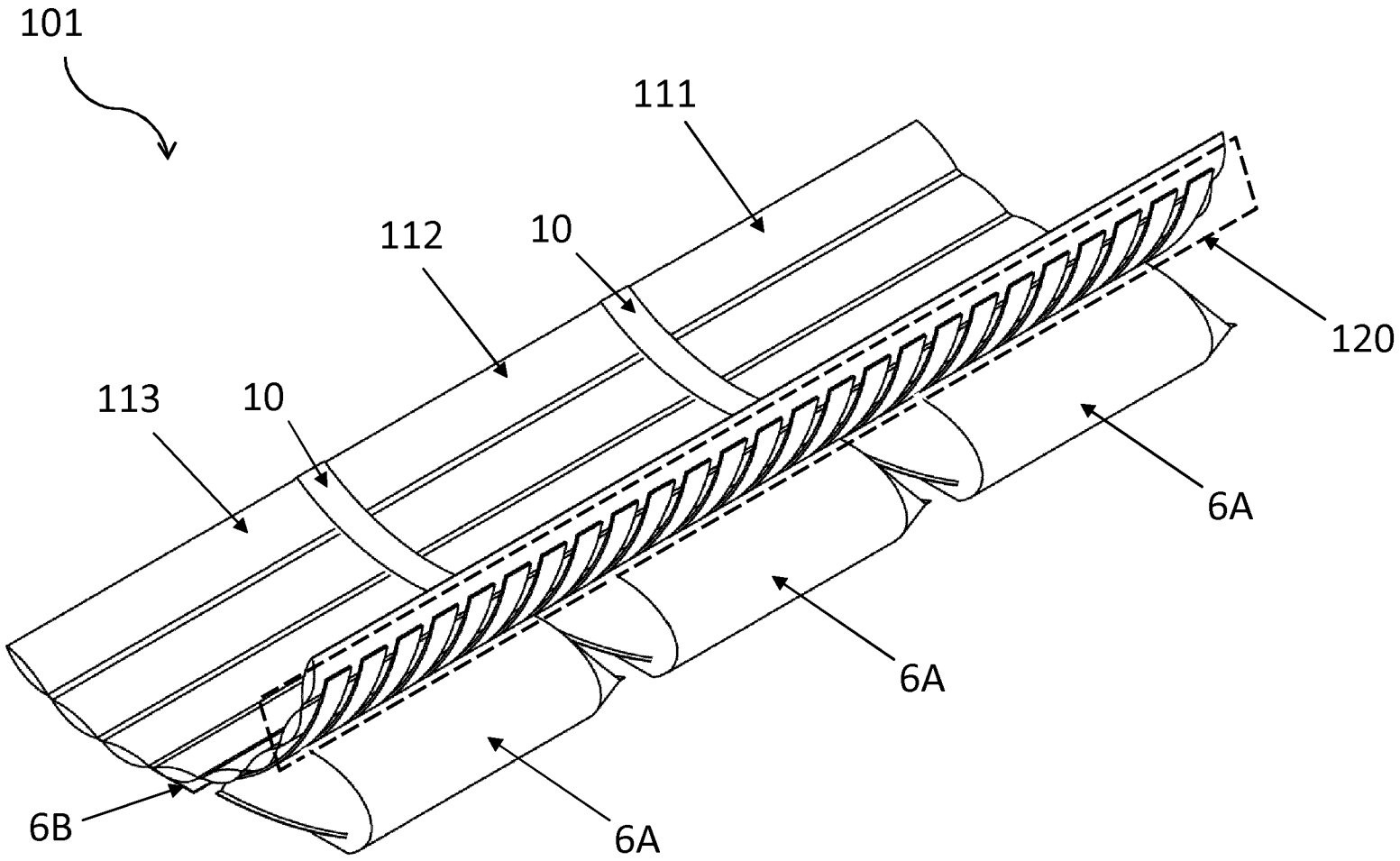
FIG. 9 shows an overview of a support structure according to one or more embodiments.

The body 110 may in different embodiments comprise at least two parts that are tiltable relative to each other around an axis perpendicular to their longitudinal sides, and arranged on respective sides of an intermediate flexible area 10, wherein the at least two parts are connected via one or more respective intermediate flexible area 10 made of flexible material and being adapted to change its shape when the at least two parts are tilted relative to each other. The carrier plate 120 may correspondingly comprise at least two separate parts arranged on respective sides of the intermediate flexible area 10. As illustrated in FIGS. 5, 8 and 9, the body 110 may for example comprise an upper part 111, a middle part 112 and a bottom part 113, wherein the upper part 111 and the middle part 112 are tiltable relative to each other around an axis perpendicular to their longitudinal sides and arranged on respective sides of a first intermediate flexible area 10, and wherein the middle part 112 and the bottom part 113 are tiltable relative to each other around an axis perpendicular to their longitudinal sides and arranged on respective sides of a second intermediate flexible area 10, and wherein the at least two separate parts of the carrier plate 120 comprises a corresponding upper part 121, middle part 122 and bottom part 123.

In one or more embodiments, the parts of the support structure (101) that are adapted to be pressurized via a respective valve 104 further comprises one or more inflatable longitudinal tilt cell 14, attached to the back surface 124 of a respective part of the carrier plate 120. In FIG. 8, there is illustrated an embodiment wherein a single inflatable longitudinal tilt cell 14 is attached to the back surface 124 of the upper part 121 of the carrier plate. The one or more inflatable longitudinal tilt cell 14 may be adapted to, when in a pressurized loaded (at least partially inflated) condition, tilt a part of the body 110 to which the selected part of the carrier plate 120 is attached, in the example if FIG. 8 corresponding to the upper part 111, relative to the neighboring part or parts of the body 110, such that the person on the support structure 101 is for example aided in sitting up.

Of course, the system 100 described herein is not limited to a certain number of parts for either the body or the carrier plate, any suitable number may apply. A division of the body into two tiltable parts and the carrier plate into at least two parts, wherein the division between the carrier plate parts is co-located with the division of the body parts, is sufficient to enable a folding motion to assist a person lying on the system to for example lift his/her head or come to a more upright sitting position, when combined with the one or more inflatable longitudinal tilt cells 14. The pressurization objective, expressed in the form of a control signal 135 and used by the data processor to control the pressure unit 170 to pressurize the elongated elements 1, inflatable lateral tilt cells 6A and 6B and the one or more inflatable longitudinal tilt cell 14 would be to pressurize to achieve the aim of helping the person sit up. This pressurization objective may have been used before, for the same person or a different person, whereby preset settings may be obtainable from the database 190 or the machine learning module 180. Alternatively, the one or more sensors 140 may register movement by the person, which the data processor can interpret as an attempt to switch position, whereby the data processor 130 computes a suitable pressurization pattern/flow to assist the person in continuing the motion, and generates a control signal based on the calculation, whereby the controller 130 controls the pressure unit 170 to pressurize the elongated sections 1 and the lateral tilt cells 6A, 6B and longitudinal tilt cell, or cells, 14 accordingly. With the three parts described above: upper, middle and bottom (see FIGS. 5 8 and 9), more fine-tuned movements can be achieved.

The number of parts/divisions may hence be adapted according to the intended application of the system.

Furthermore, if the body 110 and carrier plate 120 are divided into a large number of respective parts, as exemplified in FIG. 9, the support structure 101 can be folded, or even rolled up, for easier storage and transportation. Folding is of course possible to some extent if there are at least two parts, but the optimal number of parts for folding and/or rolling up the support structure 101 may vary depending on the materials used and on how the support structure 101 is intended to be used. For example, three parts (or more) enables the support structure 101 for use with a regular bed in hospitals; nursing homes, etc., which typically comprise three tiltable parts that the support structure 101 can be configured to mirror. The material of the carrier plate 120 may further advantageously be selected such that it is stiff enough to maintain any shape that the carrier plate 120 takes during pressurization, and return to its initial shape, i.e. substantially planar, after depressurization of the body 110. In other words, the material should not be such that any plastic deformation takes place. The thickness of the carrier plate 110 may be selected depending on circumstances such as the material used and the intended application of the support structure 101. If the carrier plate 120 can be kept as thin as possible for the selected material, while still maintaining correct stiffness and as described above, this is advantageous as it leads to low weight, small size, and optimized folding, rolling, transportation and folding properties.

The power unit 170 may be adapted to pressurize the one or more lateral tilt cells 6A, 6B and/or longitudinal tilt cell, or cells, 14. Correspondingly, the control signal 135 may further be indicative of individual pressurization of each of the one or more lateral tilt cells 6A, 6B and/or longitudinal tilt cell, or cells, 14, in embodiments wherein each of the one or more lateral tilt cells 6A, 6B and/or longitudinal tilt cell, or cells, 14 define separate parts of the support structure 101. The controller 130 may in these embodiments further be configured to control the power unit 170 to pressurize one or more lateral tilt cells 6A, 6B and/or longitudinal tilt cell, or cells, 14 individually, based on the control signal 135.

The units of the system 100 may be configured to use any suitable wired and/or wireless communication technologies known in the art for communicating with each other.

The solution according to embodiments presented herein empowers user by restoring control over their own movements. This means no disturbance and pain from getting manually turned. For health personnel this means no heavy lifting and increased time for patient care. For hospitals it means reduced cost.

Intended user groups are for example elderly people who have mobility difficulties, people with neurological disorders who have similar challenges due to stiffness in the body, people suffering from poor blood circulation, poor air flow, poor digestion or poor sleep quality, etc., who would all benefit greatly from the solution according to embodiments presented herein The support structure could be used in nursing homes or hospitals, as well as at home for home nursing or for personal use by private individuals.

Method Embodiments

Figure 7:
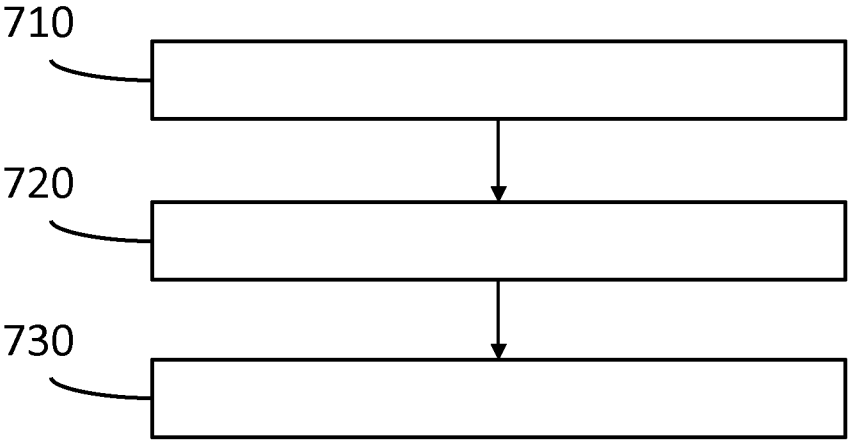
FIG. 7 is a flow chart of a method according to one or more embodiments.

FIG. 7 shows a method according to one or more embodiments for controlling the pressurization of a support structure for handling of a person located on the support structure, comprising:

In step 710: receiving, in a controller connected to the support structure, sensor measurement data indicating movement of the person located on the support structure, and/or pressure changes or other variations or deviations in pressurized parts of the support structure, from one or more sensors.

In step 720: generating, by a data processor comprised in the controller, a control signal indicative of individual pressurization of each of the parts of the support structure that is adapted to be pressurized, based at least on the received sensor measurement data.

In different embodiments, a part of the support structure may comprise a single elongated section 1, a single tilt cell, or any group or combination of elongated sections 1 and/or tilt cells.

In one or more embodiments, the method further comprises receiving, via a user interface, user input parameters. According to these embodiments, generating the control signal may further be based on the received user input parameters.

In one or more embodiments, the method further comprises receiving, in the data processor, input from a machine learning module. According to these embodiments, generating the control signal may, in combination with the sensor measurement data and optionally also the user input parameters, further be based on the received input from the machine learning module.

In step 730: controlling, by the controller, a power unit connected to the support structure to individually pressurize each part of the support structure that is adapted to be pressurized, via a respective valve, based on the control signal.

The pressurization may be pneumatically or hydraulically induced.

Further Embodiments

All of the process steps, as well as any sub-sequence of steps, described with reference to FIG. 7 above may be controlled by means of a programmed data processor. Moreover, although the embodiments of the invention described above with reference to the drawings comprise a data processor and processes performed in at least one processor, the invention thus also extends to computer programs, particularly computer programs on or in a carrier, adapted for putting the invention into practice. The program may be in the form of source code, object code, a code intermediate source and object code such as in partially compiled form, or in any other form suitable for use in the implementation of the process according to the invention. The program may either be a part of an operating system, or be a separate application. The carrier may be any entity or device capable of carrying the program. For example, the carrier may comprise a storage medium, such as a Flash memory, a ROM (Read Only Memory), for example a DVD (Digital Video/Versatile Disk), a CD (Compact Disc) or a semiconductor ROM, an EPROM (Erasable Programmable Read-Only Memory), an EEPROM (Electrically Erasable Programmable Read-only Memory), or a magnetic recording medium, for example a floppy disc or hard disc. Further, the carrier may be a transmissible carrier such as an electrical or optical signal which may be conveyed via electrical or optical cable or by radio or by other means. When the program is embodied in a signal which may be conveyed directly by a cable or other device or means, the carrier may be constituted by such cable or device or means.

Alternatively, the carrier may be an integrated circuit in which the program is embedded, the integrated circuit being adapted for performing, or for use in the performance of, the relevant processes.

In one or more embodiments, there may be provided a computer program loadable into a memory communicatively connected or coupled to at least one data processor, e.g. the data processor 150, comprising software for executing the method according any of the embodiments herein when the program is run on the at least one data processor 150.

In one or more further embodiment, there may be provided a processor-readable medium, having a program recorded thereon, where the program is to make at least one data processor, e.g. the data processor 150, execute the method according to of any of the embodiments herein when the program is loaded into the at least one data processor.

The invention is not restricted to the described embodiments in the figures, but may be varied freely within the scope of the claims.

The invention claimed is:

1. A system (100) for controlling the pressurization of a support structure (101) for handling of a person, the system (100) comprising:

a support structure (101) adapted to be placed on a base surface (102), the support structure (101) comprising:

i) a body (110), having a front surface (112) adapted to receive the person, and a back surface (114), the body (110) comprising a row of at least two elongated sections (1) made substantially of a first, flexible, material, wherein each elongated section (1) is attached to its neighboring elongated section, or sections (1), along its longitudinal side, or sides, (116), wherein the elongated sections (1) are adapted to be pressurized;

ii) a carrier plate (120) having a front surface (122) and a back surface (124), wherein the carrier plate (120) is made of a second material that is less flexible than the first material, wherein the back surface (114) of each elongated section (1) is attached to the front surface (122) of the carrier plate (120) in at least one point (4), wherein, in a pressurized loaded condition of one or more of the elongated sections (1), the carrier plate (120) is adapted to form an at least partially concavely curved front surface (122); and a power unit (170) adapted to pressurize one or more parts of the support structure (101) that are adapted to be pressurized, wherein each of said one or more parts of the support structure (101) that is adapted to be pressurized comprises at least one elongated section (1, wherein the one or more parts of the support structure 101 that is adapted to be pressurized are configured to be individually pressurized via a respective valve (104);

one or more sensors (140) adapted to measure movements of the person and/or variations or deviations in pressurized parts of the support structure in the system (100); and a controller (130) comprising a data processor (150), the data processor (150) being configured to generate a control signal (135) indicative of individual pressurization of each part of the support structure (101) that is adapted to be pressurized via the respective valve (104) based at least on sensor measurement data from the one or more sensors (140), wherein the controller (130) is configured to control the power unit (170) to pressurize each part of the support structure (101) that is adapted to be pressurized via the respective valve (104) individually in response to the control signal (135).

2. The system (100) of claim 1, further comprising a user interface (160) configured to forward user input parameters to the data processor (150), wherein the data processor (150) is further configured to generate the control signal (135) based on the user input parameters.

3. The system (100) of claim 1, wherein the data processor (150) is further configured to generate the control signal (135) based on input from a machine learning module (180).

4. The system (100) according to claim 1, wherein the parts of the support structure (101) that are adapted to be pressurized via the respective valve (104) further comprise:

two or more inflatable lateral tilt cells (6A) located along a first longitudinal side of the support structure (101), attached to the back surface (124) of the carrier plate (120); and two or more inflatable lateral tilt cells (6B) located along a second longitudinal side of the support structure (101), attached to the back surface (124) of the carrier plate (120);

wherein the two or more inflatable lateral tilt cells (6A, 6B) on each side are adapted to, when in a pressurized loaded condition, tilt the body (110) and the carrier plate (120).

5. The system (100) of claim 4, wherein the controller (130) is further configured to individually control the pressurization of each of the two or more inflatable lateral tilt cells (6A, 6B) along each side of the support structure (101) in response to the control signal (135).

6. The system (100) according to claim 1, wherein the body (110) of the support structure (101) comprises at least two parts that are tiltable relative to each other around an axis perpendicular to their longitudinal sides, wherein the at least two parts are connected via one or more respective intermediate flexible area (10) made of flexible material and being adapted to change its shape when the at least two parts are tilted relative to each other, and wherein the carrier plate (120) of the support structure (101) comprises at least two separate parts arranged on respective sides of the intermediate flexible area (10).

7. The system (100) according to claim 6, wherein the body (110) of the support structure (101) comprises an upper part (111), a middle part (112) and a bottom part (113), wherein the upper part (111) and the middle part (112) are tiltable relative to each other, and wherein the middle part (112) and the bottom part (113) are tiltable relative to each other around an axis perpendicular to their longitudinal sides, and wherein the at least two separate parts of the carrier plate (120) of the support structure (101) comprises an upper part (121), a middle part (122) and a bottom part (123) arranged on respective sides of two intermediate flexible areas (10).

8. The system of claim 6, wherein the parts of the support structure (101) that are adapted to be pressurized via a respective valve (104) further comprise:

one or more inflatable longitudinal tilt cells (14), attached to the back surface (124) of a selected part of the carrier plate (120), for example the upper part (121), wherein the one or more inflatable longitudinal tilt cell (14) is adapted to, when in a pressurized loaded condition, tilt a part of the body (110) to which the selected part of the carrier plate (120) is attached relative to the neighboring part or parts of the body (110).

9. The system (100) according to claim 1, wherein the first material is a polymer or a nylon-based material.

10. The system (100) according to claim 1, wherein the power unit (170) is further adapted to pressurize at least one additional part of the support structure (101) adapted to be pressurized, wherein each of the at least one additional part of the support structure (101) comprises a lateral tilt cell (6A, 6B) and/or longitudinal tilt cell (14) of the support structure (101), wherein the control signal (135) is further indicative of individual pressurization of each of the at least one additional part of the support structure (101), and wherein the controller (130) is further configured to control the power unit (170) to pressurize the at least one additional part of the support structure (101) individually.

11. The system (100) according to claim 1, wherein the support structure (101) comprises a mattress or a bed rest (103), or is intended for use with a mattress or a bed rest (103).

12. A method for controlling the pressurization of a support structure (101) for handling of a person located on the support structure (101), the method comprising:

receiving, in a controller (130) connected to the support structure (101), sensor measurement data indicating movement of the person located on the support structure (101), and/or pressure changes or other variations or deviations in pressurized parts of the support structure (101), from one or more sensors (140);

generating, by a data processor (150) comprised in the controller (130), a control signal (135) indicative of individual pressurization of each of the parts of the support structure (101) that is adapted to be pressurized, based at least on the received sensor measurement data; and controlling, by the controller, a power unit (170) connected to the support structure to individually pressurize each part of the support structure (101) that is adapted to be pressurized via a respective valve (104), based on the control signal (135).

13. The method of claim 12, further comprising receiving, via a user interface (160), user input parameters, wherein generating the control signal (135) is further based on the received user input parameters.

14. The method of claim 12, further comprising receiving, in the data processor (150), input from a machine learning module (180), wherein generating the control signal (135) is further based on the received input from the machine learning module (180).

15. A computer program loadable into a memory communicatively connected or coupled to at least one data processor, comprising software for executing the method according to the method of claim 12 when the program is run on the at least one data processor.

16. A processor-readable medium, having a program recorded thereon, where the program is to make at least one data processor execute the method according to the method of claim 12 when the program is loaded into the at least one data processor.

* * * * *